United States Patent [19]

Powers et al.

[11] 3,942,950

[45] Mar. 9, 1976

[54] PROCESS FOR THE DYEING OF POLYBENZIMIDAZOLE FIBERS WITH ANIONIC DYESTUFFS

[75] Inventors: Edward J. Powers, Gillette; Walter P. Hassinger, Berkeley Heights, both of N.J.

[73] Assignee: Celanese Corporation, New York, N.Y.

[22] Filed: Dec. 27, 1974

[21] Appl. No.: 536,807

[52] U.S. Cl. ..... 8/173; 8/162 R; 8/175

[51] Int. Cl.[2] ..... D06P 5/04; D06P 1/68; D06P 3/40

[58] Field of Search ..... 8/173

[56] References Cited

UNITED STATES PATENTS

| | | | |
|---|---|---|---|
| 2,895,948 | 7/1959 | Brinker et al. | 260/784 |
| 3,836,500 | 9/1974 | Calundann | 260/32.6 N |

OTHER PUBLICATIONS

Vogel and Marvel, *J. Polymer Science*, 1961, 50, pp. 511–539.

Burrel, *Interchemical Review*, Spring 1955.

*Primary Examiner*—Joseph L. Schofer

*Assistant Examiner*—A. L. Clingman

[57] ABSTRACT

Heretofore polybenzimidazole fibrous materials have proven to be extremely difficult to dye successfully. The present invention provides an effective route for the achievement of a satisfactorily dyed polybenzimidazole fibrous material. The fibrous material initially is contacted at an elevated temperature with a liquid (e.g., an aqueous emulsion) comprising an organic swelling agent and salicylic acid to form polybenzimidazonium salicylate, and subsequently is dyed with an anionic dyestuff. Complete and uniform dye penetration is made possible through the use of the present process, and the resulting dyed article is capable of resisting dye sublimation when utilized in an environment where elevated temperatures are encountered.

20 Claims, No Drawings

PROCESS FOR THE DYEING OF POLYBENZIMIDAZOLE FIBERS WITH ANIONIC DYESTUFFS

BACKGROUND OF THE INVENTION

Polybenzimidazole fibrous materials are a recognized class of fibers exhibiting non-burning characteristics and a great resistance to degradation by heat, hydrolytic, and oxidizing media. Polybenzimidazole fibers are good insulating materials and do not give off toxic fumes when heated. Such fibers particularly are suited for use in applications where high temperature resistance and the safety afforded by a non-combustible fiber is of importance. For instance, such fibers heretofore have been utilized in the production of space suits, parachutes, and ropes intended for use in outer space. Other potential uses for polybenzimidazole fibers include: protective clothing for firemen, operators in steel and glass mills, and pilots of military aircraft; furnishings in critical areas such as carpets, drapes and upholstery, in spacecraft, submarines, commercial aircraft, hospitals, nursing homes, etc.

The polybenzimidazole fibrous materials inherently are of a light gold color to dark brown color. As discussed in commonly assigned U.S. Pat. No. 3,836,500, such fibers commonly darken upon aging.

Polybenzimidazole fibers tend to be relatively amorphous, and are found to possess a greater number of potential acid dye sites than wool. However, prior attempts at the application of any dye class by standard dyeing techniques heretofore has been unsuccessful. When the dyeing of polybenzimidazole fibers has been attempted in the prior art, the dye penetration generally has tended to be poor, and often the dye has been readily removable from the fiber surface. The difficulties encountered when attempting to dye polybenzimidazole fibers may be attributed at least in part to the relatively high glass transition temperature of the same, e.g. 350° to 375°C. There accordingly has remained a need for a reliable technique to satisfactorily dye polybenzimidazole fibers so that aesthetically pleasing shades other than that inherently produced may be combined with its other highly desirable utilitarian characteristics. Also, the ability to provide satisfactorily dyed polybenzimidazole fibrous materials is of importance when the end use is in a fabric intended for forming flight suits where a bright highly visible color is helpful in the spotting of downed aviators in emergency situations.

It is an object of the invention to provide an improved process for the dyeing of polybenzimidazole fibers.

It is an object of the invention to provide an improved process for the dyeing of polybenzimidazole fibers with an anionic dyestuff.

It is an object of the invention to provide an improved process for the dyeing of polybenzimidazole fibers which may be carried out at moderate temperatures substantially below the glass transition temperature of the polybenzimidazole.

It is another object of the invention to provide an improved process for the dyeing of polybenzimidazole fibers wherein complete and uniform dye penetration is accomplished.

It is another object of the invention to provide an improved process for the dyeing of polybenzimidazole fibers wherein the dyed product exhibits satisfactory washfastness, crockfastness, dryclean fastness.

It is a further object of the invention to provide an improved process for the dyeing of polybenzimidazole fibers wherein the dye present in the dyed fibrous product is resistant to sublimation at elevated temperatures.

These and other objects, as well as the scope, nature, and utilization of the process will be apparent from the following description and appended claims.

SUMMARY OF THE INVENTION

It has been found that an improved process for the dyeing of a polybenzimidazole fibrous material with an anionic dye comprises contacting the polybenzimidazole fibers with a liquid provided at an elevated temperature comprising:

a. an organic swelling agent for the polybenzimidazole having a solubility parameter when in contact with the fiber of about 11 to 13, and b. about 0.05 to 5 percent by weight based upon the weight of the liquid of salicylic acid, whereby the polybenzimidazole undergoes chemical reaction to form polybenzimidazonium salicylate, and dyeing the resulting fibers by contact with a dyebath comprising an anionic dyestuff.

DESCRIPTION OF PREFERRED EMBODIMENTS

The Starting Material

The polybenzimidazole fibrous material which serves as the starting material in the present process may be formed by any one of a variety of techniques.

Polybenzimidazoles are a known class of heterocyclic polymers. Typical polymers of this class are described in U.S. Pat. No. 2,895,948, U.S. Pat. No. Re. 26,065, and in the *Journal of Polymer Science*, Vol. 50, pages 511–539 (1961) which are herein incorporated by reference. The polybenzimidazoles consist essentially of recurring units of the following Formulas I and II. Formula I is:

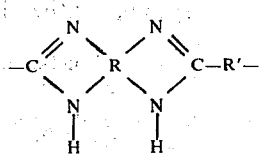

wherein R is a tetravalent aromatic nucleus, preferably symmetrically substituted, with the nitrogen atoms forming the benzimidazole rings being paired upon adjacent carbon atoms, i.e. ortho carbon atoms, of the aromatic nucleus, and R′ is a member of the class consisting of (1) an aromatic ring, (2) an alkylene group (preferably those having 4 to 8 carbon atoms), and (3) a heterocyclic ring from the class consisting of (a) pyridine, (b) pyrazine, (c) furan, (d) quinoline, (e) thiophene, and (f) pyran.

Formula II is:

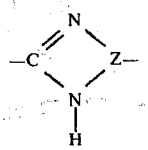

wherein Z is an aromatic nucleus having the nitrogen atoms forming the benzimidazole ring paired upon adjacent carbon atoms of the aromatic nucleus.

Preferably, aromatic polybenzimidazoles are selected, e.g., polymers consisting essentially of the recurring units of Formulas I and II wherein R′ is at least one aromatic ring or a heterocyclic ring.

As set forth in U.S. Pat. No. RE 26,065, the aromatic polybenzimidazoles having the recurring units of Formula II may be prepared by self-condensing a trifunctional aromatic compound containing only a single set of ortho disposed diamino substituents and an aromatic, preferably phenyl, carboxylate ester substituent. Exemplary of polymers of this type is poly-2,5(6)-benzimidazole prepared by the autocondensation of phenyl-3,4-diaminobenzoate.

As also set forth in the above-mentioned patent, the aromatic polybenzimidazoles having the recurring units of Formula I may be prepared by condensing an aromatic tetraamine compound containing a pair of orthodiamino substituents on the aromatic nucleus with a dicarboxyl compound selected from the class consisting of (a) the diphenyl ester of an aromatic dicarboxylic acid, (b) the diphenyl ester of a heterocyclic dicarboxylic acid wherein the carboxyl groups are substituents upon a carbon in a ring compound selected from the class consisting of pyridine, pyrazine, furan, quinoline, thiophene, and pyran and (c) an anhydride of an aromatic dicarboxylic acid.

Examples of polybenzimidazoles which have the recurring structure of Formula I are as follows:

poly-2,2′-(m-phenylene)-5,5′-bibenzimidazole;
poly-2,2′-(pyridylene-3″,5″)-5,5′-bibenzimidazole;
poly-2,2′-(furylene-2″,5″)-5,5′-bibenzimidazole;
poly-2,2′-(naphthalene-1″,6″)-5,5′-bibenzimidazole;
poly-2,2′-(biphenylene-4″,4″)-5,5′-bibenzimidazole;
poly-2,2′-amylene-5,5′-bibenzimidazole;
poly-2,2′-octamethylene-5,5′-bibenzimidazole;
poly-2,6-(m-phenylene)-diimidazobenzene;
poly-2,2′-cyclohexeneyl-5,5′-bibenzimidazole;
poly-2,2′-(m-phenylene)-5,5′-di(benzimidazole)ether;
poly-2,2′-(m-phenylene)-5,5′-di(benzimidazole) sulfide;
poly-2,2′-(m-phenylene)-5,5′-di(benzimidazole) sulfone;
poly-2,2′-(m-phenylene)-5,5′-di(benzimidazole) methane;
poly-2′,2″-(m-phenylene)-5′,5″-di(benzimidazole) propane-2,2; and
poly-2′,2″-(m-phenylene)-5′,5″-di(benzimidazole) ethylene-1,2 where the double bonds of the ethylene groups are intact in the final polymer.

The preferred polybenzimidazole for use in the present process is one prepared from poly-2,2′-(m-phenylene)-5,5′-bibenzimidazole, the recurring unit of which is:

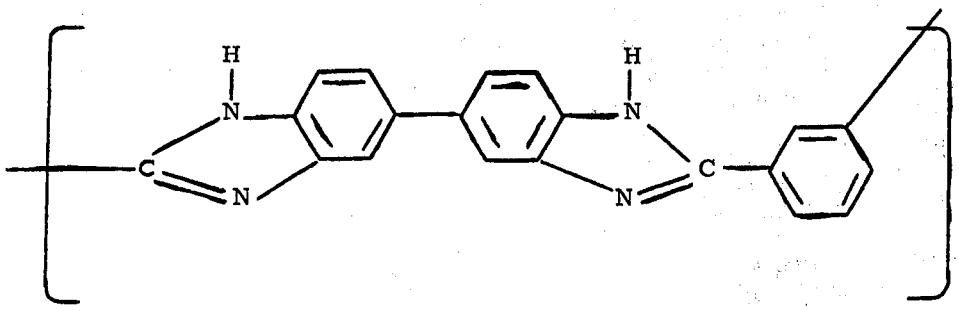

Any polymerization process known to those skilled in the art may be employed to prepare the polybenzimidazole which may then be formed into a fibrous material. Representative techniques for preparing the polybenzimidazole are disclosed in U.S. Pat. Nos. 3,509,108; 3,549,603; and 3,551,389, which are assigned to the assignee of the present invention and are herein incorporated by reference.

With respect to aromatic polybenzimidazoles, preferably equimolar quantities of the monomeric tetraamine and dicarboxyl compound are introduced into a first stage melt polymerization reaction zone and heated therein at a temperature above about 200°C., preferably at least 250°C., and more preferably from about 270° to 300°C. The reaction is conducted in a substantially oxygen-free atmosphere, i.e., below about 20 ppm oxygen and preferably below about 8 ppm oxygen, until a foamed prepolymer is formed having an inherent viscosity, expressed as deciliters per gram, of at least 0.1 and preferably from about 0.13 to 0.3, the inherent viscosity (I.V.) as used herein being determined from a solution of 0.4 grams of the polymer in 100 ml. of 97 percent $H_2SO_4$ at 25°C.

After the conclusion of the first stage reaction, which normally takes at least 0.5 hour and preferably 1 to 3 hours, the foamed prepolymer is cooled and then powdered or pulverized in any convenient manner. The resulting prepolymer powder is then introduced into a second stage polymerization reaction zone wherein it is heated under substantially oxygen-free conditions, as described above, to yield a polybenzimidazole polymer product, desirably having an I.V., as measured above, of at least 0.6, e.g., 0.80 to 1.1 or more.

The temperature employed in the second stage is at least 250°C., preferably at least 325°C., and more preferably from about 350° to 425°C. The second stage reaction generally takes at least 0.5 hour, and preferably from about 1 to 4 hours or more.

A particularly preferred method for preparing the polybenzimidazole is disclosed in the aforesaid U.S. Pat. No. 3,509,108. As disclosed therein aromatic polybenzimidazoles may be prepared by initially reacting the monomer in a melt phase polymerization at a temperature above about 200°C. and a pressure above 50 psi(e.g., 300 to 600 psi) and then heating the resulting reaction product in a solid state polymerization at a temperature above about 300°C. (e.g., 350° to 500°C.) to yield the final product.

The term polybenzimidazole "fibrous material" as used herein includes staple fiber, monofilaments, as well as multifilament fibrous materials, such as yarn, strand, cable, tow or other continuous or discontinuous fibrous assemblages. In a preferred embodiment of the process the polybenzimidazole fibrous material is staple fiber, staple yarn, multifilament yarn, multifilament tow, or fabric formed therefrom. In a particularly preferred embodiment of the process the dyeing is conducted on staple fiber prior to the formation of a fiber assemblage in which the fiber ultimately is used.

As is known in the art, polybenzimidazoles are generally formed into continuous lengths of fibrous materials by solution spinning, that is, by dry or wet spinning a solution of the polymer in an appropriate solvent such as N,N-dimethylacetamide, N,N-dimethylformamide, dimethylsulfoxide or sulfuric acid (used only in wet spinning) through an opening of predetermined shape into an evaporative atmosphere for the solvent in which most of the solvent is evaporated (dry) or into a coagulation bath (wet), resulting in the polymer having the desired filamentary shape.

The polymer solutions may be prepared in accordance with known procedures. For example, sufficient polybenzimidazole may be dissolved in the solvent to yield a final solution suitable for extrusion containing from about 10 to 45 percent by weight of the polymer, based on the total weight of the solution, preferably from about 20 to 30 percent by weight.

One suitable means for dissolving the polymer in the solvent is by mixing the materials at a temperature above the atmospheric boiling point of the solvent, for example 25° to 120°C. above such boiling point, and at a pressure of 2 to 15 atmospheres for a period of 1 to 5 hours.

Preferably, the polymer solutions, after suitable filtration to remove any undissolved portions, are dry spun. For example, the solutions may be extruded through a spinneret into a conventional type downdraft spinning columnn containing a circulating inert gas such as nitrogen, noble gasses, combustion gasses, or superheated steam. Conveniently, the spinneret face is at a temperature of from about 100° to 170°C., the top of the column from about 120° to 220°C., the middle of the column from about 140° to 250°C., and the bottom of the column from about 160° to 320°C. After leaving the spinning column, the continuous filamentary materials are taken up, for example, at a speed within the range of about 50 to 350 meters or more per minute. If the continuous filamentary materials are to be washed while wound on bobbins, the resulting "as-spun" materials may be subjected to a slight steam drawing treatment at a draw ratio from about 1.05:1 to 1.5:1 in order to prevent the fibers from relaxing and falling off the bobbin during the subsequent washing step. Further details with respect to a method for dry-spinning a continuous length of a polybenzimidazole fibrous material are shown in U.S. Pat. No. 3,502,756 to Bohrer et al. which is assigned to the same assignee as the present invention and is herein incorporated by reference.

The continuous length of polybenzimidazole fibrous material is next washed so as to remove at least the major portion of residual spinning solvent, e.g., so that the washed materials contain less than about 1 percent by weight solvent based on the weight of the continuous filamentary material, and preferably so as to obtain an essentially spinning solvent-free fibrous material (i.e., a fibrous material containing less than about 0.1 percent solvent by weight). Typically, a simple water wash is employed; however, if desired, other wash materials such as acetone, methanol, methylethyl ketone and similar solvent-miscible and volatile organic solvents may be used in place of or in combination with the water. The washing operation may be conducted by collecting the polybenzimidazole fibrous material on perforated rolls or bobbins, immersing the rolls in the liquid wash bath and pressure washing the fibrous material, for example, for about 2 to 48 hours or more. Alternatively, the continuous length of polybenzimidazole fibrous material may be washed on a continuous basis by passing the fibrous material in the direction of its length through one or more liquid wash baths (e.g., for 1 to 10 minutes). Any wash technique known to those skilled in the art may be selected.

The continuous length of polybenzimidazole fibrous material may next be dried to remove the liquid wash bath by any convenient technique. For instance, the drying operation for bobbins of yarn may be conducted at a temperature of about 150° to 300°C. for about 2 to 100 hours or more. Alternatively, the continuous length of polybenzimidazole fibrous material may be dried on a continuous basis by passing the fibrous material in the direction of its length through an appropriate drying zone (e.g., an oven provided at 300° to 400°C. for 1 to 2 minutes). If drying is employed, preferably the drying temperature does not exceed about 250°C. for several hours or 400°C. for more than 1 minute, as above these limits degradation of the fiber may occur.

The polybenzimidazole fibrous material preferably next is hot drawn at a draw ratio of about 2:1 to 5:1 in order to enhance its orientation. Representative drawn procedures are disclosed in commonly assigned U.S. Pat. Nos. 3,622,660, and 3,849,529.

The polybenzimidazole fibrous material when intended for textile applications is usually crimped and cut into staple form. For example, a crimp of about 10 to 15 crimps per inch may be imparted to the same prior to cutting into lengths of about 2 inches. This crimped staple fiber may then be spun into yarns of from about 14's to 60's cotton count. Fabric next may be formed by weaving or knitting.

THE FORMATION OF POLYBENZIMIDAZONIUM SALICYLATE

The polybenzimidazole fibrous material is contacted with a liquid provided at an elevated temperature comprising an organic swelling agent (as defined), and salicylic acid to form polybenzimidazonium salicylate. As previously indicated, the polybenzimidazole fibers may be a variety of configurations.

The organic swelling agent has a solubility parameter $\delta$ when in contact with the fiber of about 11 to 13 and is incapable of dissolving the fiber. As will be apparent to those skilled in the art, the solubility parameter of a given compound may be determined via conventional techniques, such as from the heats of vaporization. $\delta=(\Delta E/V)^{1/2}$ where $\Delta E$ is the energy of vaporization to a gas at zero pressure and $V$ is the molal volume of the liquid. Solubility parameters also may be calculated from thermal coefficients, critical pressure or surface tension, or estimated from the structural formula of the agent using Small's molar attraction constants. See, for instance, *Interchemical Review*, Spring, 1955 by H. Burrell. Also, the solubility parameters of many common agents may be found in published tables, e.g. *J. Paint Technol.*, 42, 76 (1970) by K. L. Hoy. Upon contact with the polybenzimidazole fibrous material the swelling agent has the ability to plasticize the internal structure of the fibrous material and to render it more pervious to the ingress of other molecules. Representative swelling agents which may be utilized in the present process include: benzyl alcohol, 2-phenoxyethanol, methanol, ethanol, n-propanol, n-butanol, diethylene glycol monomethyl ether, 50 percent by volume mixtures of methanol and methylene chloride, 50 percent by volume mixtures of methanol and perchloroethylene, 50 percent by volume mixtures of ethanol and perchloroethylene, and mixtures of the foregoing. The liquid comprising the swelling agent and salicylic acid optionally may include other components which do not adversely influence the fibers, interfere with the swelling properties of the agent or alter the solubility parameter to a value outside the range of about 11 to 13.

Salicylic acid preferably is provided with the organic swelling agent in the liquid in a concentration of about 0.05 to 5 percent by weight based upon the total weight of the liquid. In a particularly preferred embodiment of the process the salicylic acid is provided in the liquid in a concentration of about 0.2 to 1 percent by weight based upon the total weight of the liquid, e.g. 0.5 percent by weight.

The particularly preferred swelling agent for use in the process is benzyl alcohol which is provided in water with salicylic acid, and a surfactant. For instance, the benzyl alcohol may be provided in the aqueous liquid in a concentration of about 3 to 20 percent by weight based upon the total weight of the liquid. In a further preferred embodiment of the process the benzyl alcohol is provided in the aqueous liquid in a concentration of about 3 to 10 percent by weight based upon the total weight of the liquid (e.g. 3 to 6 percent by weight). Particularly satisfactory results have been achieved when the benzyl alcohol is provided in the aqueous liquid in a concentration of about 6 percent by weight based upon the total weight of the liquid.

Swelling agents such as 2-phenoxyethanol or n-butanol similarly may be utilized while present with water. The other swelling agents identified can best be utilized in the substantial absence of water.

When the organic swelling agent is applied from an aqueous liquid a minor quantity of a surfactant also is provided with the water, organic swelling agent, and salicyclic acid components which enables the formation of a stable emulsion (e.g., at room temperature). The surfactant preferably is provided in a concentration of about 0.03 to 0.3 percent by weight based upon the total weight of the liquid. The preferred surfactants are those which do not unduly interfere with the formation of polybenzimidazonium salicylate as described hereafter, which may be substantially removed from the fiber following dyeing, and which do not adversely influence the properties of the resulting fiber. Particularly preferred surfactants for use in the process are the sodium salts of alkyl phosphate ester (e.g., GAFAC-MC-470 surfactant available from the GAF Corporation).

During the formation of the polybenzimidazonium salicylate the polybenzimidazole fibrous material preferably is immersed in the liquid containing the organic swelling agent and salicylic acid for about 5 to 30 minutes, and the liquid conveniently provided at an elevated temperature within the range of about 40° to 97°C. during at least a portion of the contact with the polybenzimidazole fibers. The maximum temperature utilized will, of course, be influenced by the boiling point of the organic swelling agent.

The formation of the polybenzimidazonium salicylate may be carried out in conventional dyeing equipment as a pretreatment step prior to actually dyeing the fiber. Those considerations familiar to those skilled in the art of dyeing should guide the selection of equipment to afford optimum levelness both in the absorption of salicylic acid by the polybenzimidazole and subsequently of the dyes by the polybenzimidazonium salicylate. Such equipment usually has provision for the dilution of additives in the dyebath before the additives contact the fiber and employs a dynamic interaction between the dye-liquor and the fiber. Using the appropriate equipment, the process of the present invention may be applied to dye staple in loose or cake form, filament or spun yarn in skin or package form, or fabric.

The liquid preferably is provided in a quantity such that its weight exceeds that of the polybenzimidazole fibrous material undergoing treatment by about 10 to 50 times, and most preferably by about 30 to 40 times. During the polybenzimidazonium salicylate forming reaction basic nitrogen atoms of the polymer undergo reaction, hydrogen ions are added, and the polymer is rendered cationic and capable of exchanging anionic dyes during dyeing. The formation of polybenzimidazonium salicylate may be confirmed by UV analysis. Preferably at least 10 percent of the reactive sites of the polybenzimidazole fibrous material undergo reaction to form polybenzimidazonium salicylate. In a preferred embodiment of the process swelling and salicylate formation are carried out at least partially in a consecutive manner rather than entirely in a simultaneous manner. For instance, the introduction of the salicylic acid into the liquid may be delayed at least until after the swelling has been initiated. Once the salicylic acid component is introduced, the temperature of the liquid may be more highly elevated. It is to be understood that at elevated temperatures when utilizing an aqueous liquid substantial portions of the benzyl alcohol and salicylic acid will pass into solution rather than being emulsified or suspended within the water continuous phase.

The formation of polybenzimidazonium salicylate surprisingly has been found to render the fibrous material capable of undergoing highly satisfactory dyeing with an anionic dyestuff thereby overcoming dyeing difficulties heretofore encountered with polybenzimidazole fibers.

The formation of a polybenzimidazonium salicylate upon reaction of poly-2,2'-(m-phenylene)-5,5'-bibenzimidazole with salicylic acid is illustrative of the salt formation reaction and can be represented by the following equation:

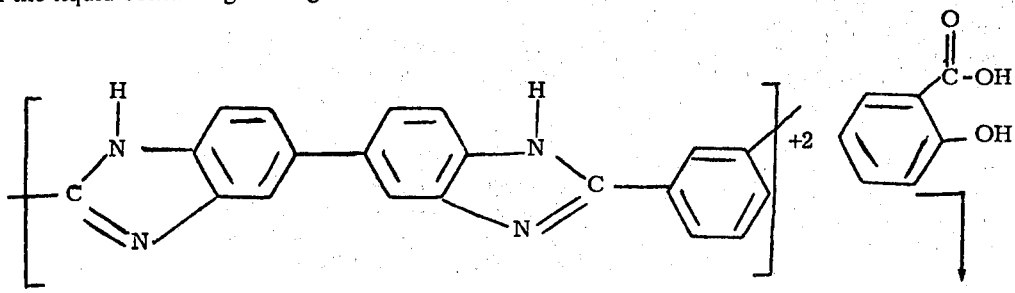

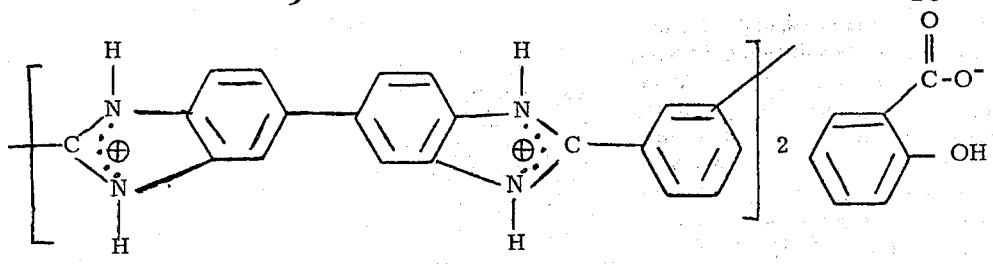

THE DYEING WITH AN ANIONIC DYESTUFF

The resulting polybenzimidazole fibrous material following the formation of polybenzimidazonium salicylate and while in swollen form may be dyed by contact with a dyebath comprising an anionic dye (i.e. a dissolved anionic dye). For instance, the anionic dyestuff may be an acid dye, direct dye, fiber reactive dye, or solubilized vat dye, etc. In the process of the present invention the salicylate anions are displaced by the anions provided by the dyestuff. The dyeing conveniently may be carried out at a relatively low temperature of about 40° to 97°C. which is substantially below the glass transition temperature of the polybenzimidazole.

Representative acid dyes include the azo, triarylmethane, xanthene, azine, ketonimine, nitro, nitroso, antraquinone, and azocomplex dyes with acid substituents such as carboxy-, or sulfonic acid. Specific acid dyes which particularly are useful in the present process include CI Acid:Blue 102, Blue 108, Yellow 7, Yellow 29:1, Red 1, Red, 4, Red 15, Red 143, Orange 10, Blue 59, Blue 78, Blue 126, Blue 168, Orange 86, Orange 87, Orange 88, Red 211, Red 259, Yellow 116, Yellow 129, Green 57, Violet 75, and Blue 166.

Representative direct dyes which may be utilized in the present process include CI Direct: Yellow 8, Yellow 12, Yellow 27, Yellow 99, Red 37, Red 39, Red 77, Red 111, Blue 11, Blue 55, and Blue 106.

Specific fiber reactive dyes which may be utilized in the present process include CI Reactive: Yellow 27, Orange 50, Red 21, Blue 19, and Blue 27.

Specific solubilized vat dyes which may be utilized in the present process include CI Solubilized Vat: Blue 1, Blue 5, Blue 6, Red 1, Red 10, Green 1, Green 2, Yellow 7, and Violet 7.

If desired the liquid comprising the organic swelling agent, and salicylic acid, may be combined with the dissolved anionic dye so that polybenzimidazonium salicylate formation and salicylate displacement by the anionic dye take place in immediate succession. However, it is preferred for optimum results that the salicylate formation be carried out in a separate step prior to contact with the anionic dyestuff.

Furthermore, modification of these procedures by those skilled in the art will permit the continuous dyeing of a polybenzimidazole fabric by Thermosol dyeing. For instance, a formulation of swelling agent, salicylic acid, dyes, thickeners can be applied to the fiber as a paste, and the polybenzimidazonium salicylate formation and dye exchange affected by the application of heat.

Once dyeing is complete the swelling agent and remaining salicylate are removed. Representative wash techniques include exposing the fibrous material to a volume of fresh water and heating to an elevated temperature of 75° to 95°C. for 10 to 30 minutes. Alternatively, fresh water (preferably at about 75° to 95°C.) can be passed through a collection of the fibrous material until the swelling agent is removed. The remaining concentration of swelling agent (e.g. benzyl alcohol) in the fibrous material can be determined by chromatographic analysis of a dry injected sample of fiber which has been powdered in a liquid nitrogen ball mill. During such washing the internal structure of the fibers tends to collapse forming a dense non-swollen dyed fiber.

Once the swelling agent is removed the remaining polybenzimidazonium salicylate is reconverted to polybenzimidazole and the salicylate is removed from the fiber by washing in water containing a strong base (e.g. ammonium hydroxide or sodium hydroxide) using a procedure similar to that used to remove the swelling agent. The concentration of base in the wash solution should equal or preferably exceed that necessary to neutralize the polybenzimidazonium ions. In a preferred embodiment ammonium hydroxide is used in excess since any residual ammonia on the fibers will be removed during subsequent rinsing and drying steps which are commonly employed during wet textile processing.

The process of the present invention is capable of providing uniformly dyed polybenzimidazole fibers of satisfactory light, wash and crock fastness. Upon subjection to elevated temperatures the dye present within the fibers resists sublimation.

The following examples are given as specific illustrations of the invention. It should be understood, however, that the invention is not limited to the specific details set forth in the examples.

In each example a polybenzimidazole fibrous material, namely poly-2,2′-(m-phenylene)-5,5′-bibenzimidazole, is selected as the exemplary polybenzimidazole for use in carrying out the process of the invention. The fibrous material has a staple configuration and is composed of crimped filaments having a denier per filament of about 1.5 and containing about 10 to 15 crimps per inch. The fibrous material possessed the following physical properties: modulus 48 grams per denier, breaking tenacity 3.5 grams per denier, and breaking elongation 28 percent.

EXAMPLE I

Ten pounds of the polybenzimidazole staple were loosely packed into 10 cheesecloth bags and added to 150 liters of water at room temperature (i.e. 25°C.) containing 20 grams of surfactant (i.e. sodium salt of an alkyl phosphate ester marketed by the GAF Corporation under the designation GAFAC-MC-470 surfactant) in a KWG Model 10-15 paddle dyeing machine. After running for 10 minutes, an aqueous emulsion concentrate containing 12 liters of benzyl alcohol, 13 liters of water and 120 grams of the surfactant was added. The emulsion had been prepared in a separate vessel by slowly adding water to the solution of benzyl alcohol and surfactant with rapid stirring. After heating the bath to 50°C., 2 pounds of salicylic acid dissolved in 2 liters of warm methanol were added and the bath was run for 10 minutes. A water solution of 182 grams of CI Acid Blue 102 dye was added and the bath temperature was raised to 75°C. over a 90 minute period, and then rapidly to 97°C. where the bath was held for 30 minutes. Dyebath exhaustion occured before the bath reached 97°C. The dyebath was dropped, hot water was added, run for 2 minutes and dropped. The bath was raised with hot water, heated to 97°C., run for 20 minutes and dropped. The bath was raised again with hot water, 2 liters of ammonium hydroxide (29% $NH_3$) were added, the bath was heated to 97°C. and run for 20 minutes, and dropped. The staple was thoroughly rinsed, extracted, and tumble dried in the cheesecloth bags.

Fabric prepared from this staple exhibited good wash, dryclean and crock fastness.

For comparative purposes Example I is repeated with the exception that the fibrous material is not contacted with the aqueous liquid comprising benzyl alcohol and salicylic acid prior to dyeing. It is observed that the fibrous material does not dye.

For comparative purposes Example I is repeated with the exception that the salicylic acid component is omitted from the aqueous liquid. It is observed that the fibrous material does not dye.

For comparative purposes Example I is repeated with the exception that benzoic acid is substituted for salicyclic acid in the aqueous liquid. It is observed that only a very light staining of the fibrous material occurs.

EXAMPLE II

One pound of polybenzimidazole yarn (40/1cc) which was spun from similar staple was wound under minimum tension onto two steel spring forms. The forms were placed in a Gaston County laboratory package dyeing machine and about 28 liters of water were charged. Two grams of the GAFAC-MC-470 surfactant were added and the yarn was wet-out over a 10 minute period. An emulsion concentrate containing 1.2 liters of benzyl alcohol, 1.3 liters of water, and 15 grams of GAFAC-MC-470 surfactant was added, and the bath was heated to 50°C. Throughout the dyeing, the machine was set to run 3 minutes outside-in and 2 minutes inside-out, and additions were made during the outside-in cycle. Ninety grams of salicylic acid dissolved in 250 ml. of methanol were added and the machine was run for 10 minutes. A water solution of CI Acid Green 57 dye was then added and the bath was heated to 75°C. over a 2 hour period. The bath was then rapidly heated to 95°C. and run for 30 minutes. The dyebath was exhausted. The bath was drained and the yarn rinsed. Fresh water was added, the bath was heated to 95°C. and run for 20 minutes. The bath was drained and recharged with approximately 30 liters of water, and 300 ml. of ammonium hydroxide (29%$NH_3$) was added. The bath was heated to 95°C. and run for 20 minutes. The bath was drained and the yarn was rinsed. The yarn packages were removed, extracted, dried at 200°C. for 30 minutes, and then at 150°C. over night.

Fabric prepared from this yarn exhibited good wash, dryclean and crockfastness. However, the levelness of the color of this fabric was slightly inferior to that of the fabric resulting from the dyed staple of Example I.

EXAMPLE III

In an Ahiba laboratory dyeing apparatus 100 ml. of aqueous emulsion was prepared at room temperature containing 6 grams of benzyl alcohol, 0.5 grams salicylic acid, 0.06 grams of GAFAC-MC-470 surfactant, and CI Direct Blue 106 dye. A 2.5 gram sample of polybenzimidazole knitted hoseleg fabric prepared from yarn similar to that used in Example II was thoroughly wet out in distilled water and added to the dyebath. The bath was aggitated and heated to 97°C. over a 90 minute period and run for 30 minutes longer at 97°C. The fabric was then removed, thoroughly rinsed in tap water and returned to a fresh water bath (100 ml.) which was heated to 97°C. and run for 20 minutes. The fabric was removed again, rinsed and placed in 100 ml. of water containing 3 ml. of ammonium hydroxide (29% $NH_3$) and which was heated to 97°C. and run for 20 minutes. The fabric was removed, rinsed thoroughly and dried at 200°C.

EXAMPLE IV

A procedure was followed similar to that of Example III except that CI Reactive Orange 50 dye was substituted for CI Direct Blue 106 dye.

EXAMPLE V

In an Ahiba laboratory dyeing apparatus, 100 ml. of aqueous emulsion was prepared containing 10 grams of benzyl alcohol and 0.1 g. of GAFAC-MC-470 surfactant. A 2.5 gram sample of polybenzimidazole knitted hoseleg fabric similar to that used in Example III was wet-out in distilled water and added to the bath. The bath was rapidly heated to 97°C. while being aggitated, and after 40 minutes 1 gram of salicylic acid dissolved in a minimal amount of methanol was added. The bath was run for 10 minutes and cooled to room temperature. An aqueous solution of 0.1 gram of ammonium hydroxide (29% $NH_3$), 0.2 g. of sodium sulfate and 1 gram of CI Solubilized Vat Red 1 dye were then added. The bath was heated to 50°C., run for 30 minutes, heated to 75°C., run for 45 minutes and heated to 95°C., and run for 30 minutes. The fabric was removed and thoroughly rinsed in tap water. The fabric was then returned to a bath containing 2 grams of sodium dichromate, 1 gram of sulfuric acid and 1.5 grams of ammonium thiocyanate in 100 ml. of water for color development. The bath was heated to 75°C. and run for 1 hour. The fabric was thoroughly rinsed in water and returned to 250 ml. of water containing 3.5 ml. of ammonium hydroxide (29% $NH_3$). After 30 minutes exposure at 75°C., the fabric was thoroughly rinsed and dried at 200°C. for 10 minutes.

Although the invention has been described with preferred embodiments, it is to be understood that variations and modifications may be resorted to as will be apparent to those skilled in the art (e.g. the process could be carried out on a continuous basis, etc.). Such variations and modifications are to be considered within the purview and scope of the claims appended hereto.

We claim:

1. An improved process for the dyeing of a polybenzimidazole fibrous material with an anionic dye comprising:

a. reacting said polybenzimidazole fibrous material while in a swollen configuration with salicylic acid to form polybenzimidazonium salicylate, and b. dyeing said resulting fibrous material with an anionic dyestuff.

2. An improved process according to claim 1 wherein said polybenzimidazole fibrous material is poly-2,2′-(m-phenylene)-5,5′-bibenzimidazole.

3. An improved process according to claim 1 wherein said fibrous material is swollen by benzyl alcohol during step (*a*) wherein polybenzimidazonium salicylate is formed.

4. An improved process according to claim 1 wherein said anionic dyestuff utilized in step (*b*) is selected from the group consisting essentially of an acid dye, direct dye, fiber reactive dye, and solubilized vat dye.

5. An improved process for the dyeing of a polybenzimidazole fibrous material with an anionic dye comprising contacting said polybenzimidazole fibers with a liquid provided at an elevated temperature comprising:

a. an organic swelling agent for said polybenzimidazole having a solubility parameter when in contact with the fiber of about 11 to 13, and b. about 0.05 to 5 percent by weight based upon the total weight of the liquid of salicylic acid, whereby said polybenzimidazole undergoes chemical reaction to form polybenzimidazonium salicylate, and dyeing said resulting fibers by contact with a dyebath comprising an anionic dyestuff.

6. An improved process for the dyeing of a polybenzimidazole fibrous material in accordance with claim 5 wherein said polybenzimidazole fibers consist essentially of recurring units of the formula:

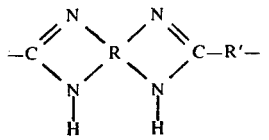

wherein R is a tetravalent aromatic nucleus, with the nitrogen atoms forming the benzimidazole rings paired upon adjacent carbon atoms of said aromatic nucleus, and R′ is selected from the group consisting of (1) an aromatic ring, (2) an alkylene group having from 4 to 8 carbon atoms, and (3) a heterocyclic ring selected from the group consisting of (*a*) pyridine, (*b*) pyrazine, (*c*) furan, (*d*) quinoline, (*e*) thiophene, and (*f*) pyran.

7. An improved process for the dyeing of a polybenzimidazole fibrous material in accordance with claim 5 wherein said polybenzimidazole fibrous material is poly-2,2′-(m-phenylene)-5,5′-bibenzimidazole.

8. An improved process for the dyeing of a polybenzimidazole fibrous material in accordance with claim 5 wherein said liquid is provided at an elevated temperature of about 50° to 97°C. during said formation of polybenzimidazonium salicylate.

9. An improved process for the dyeing of a polybenzimidazole fibrous material in accordance with claim 8 wherein said contact with said liquid is conducted for about 5 to 30 minutes.

10. An improved process for the dyeing of a polybenzimidazole fibrous material in accordance with claim 5 wherein said liquid is an aqueous emulsion wherein said organic swelling agent is emulsified in water.

11. An improved process for the dyeing of a polybenzimidazole fibrous material in accordance with claim 5 wherein said organic swelling agent is benzyl alcohol.

12. An improved process for the dyeing of a polybenzimidazole fibrous material in accordance with claim 5 wherein said salicylic acid is provided in said aqueous liquid in a concentration of about 0.2 to 1 percent by weight based upon the total weight of the liquid.

13. An improved process for the dyeing of a polybenzimidazole fibrous material in accordance with claim 5 which includes the additional steps following said dyeing of removing the swelling agent from said fibrous material, and converting remaining polybenzimidazonium salicylate to polybenzimidazole.

14. An improved process for the dyeing of a polybenzimidazole fibrous material with an anionic dye comprising contacting a poly2,2′-(m-phenylene)-5,5′-bibenzimidazole fibrous material with an aqueous liquid provided a temperature of about 40° to 97°C. comprising:

a. about 3 to 20 percent by weight based upon the total weight of the liquid of benzyl alcohol, b. about 0.05 to 5 percent by weight based upon the total weight of the liquid of salicylic acid, and c. about 0.03 to 0.3 percent by weight based upon the total weight of the liquid of a surfactant, whereby said polybenzimidazole undergoes chemical reaction to form polybenzimidazonium salicylate, and dyeing said resulting fibers by contact with a dyebath comprising an anionic dyestuff.

15. An improved process for the dyeing of a polybenzimidazole fibrous material in accordance with claim 14 wherein said contact with said aqueous liquid is conducted for about 5 to 30 minutes.

16. An improved process for the dyeing of a polybenzimidazole fibrous material in accordance with claim 14 wherein said benzyl alcohol is provided in said aqueous liquid in a concentration of about 3 to 10 percent by weight based upon the total weight of the liquid, and salicylic acid is provided in said aqueous liquid in a concentration of about 0.2 to 1 percent by weight based upon the total weight of the liquid.

17. An improved process for the dyeing of a polybenzimidazole fibrous material in accordance with claim 14 wherein said surfactant is a sodium salt of an alkyl phosphate ester.

18. An improved process for the dyeing of a polybenzimidazole fibrous material in accordance with claim 14 wherein said anionic dyestuff is selected from the group consisting essentially of an acid dye, direct dye, fiber reactive dye, and solubilized vat dye.

19. An improved process for the dyeing of a polybenzimidazole fibrous material in accordance with claim 18 wherein said anionic dyestuff is an acid dye.

20. An improved process for the dyeing of a polybenzimidazole fibrous material in accordance with claim 14 which includes the additional steps following said dyeing of removing said benzyl alcohol from said fibrous material, and converting remaining polybenzimidazonium salicylate to polybenzimidazole.

* * * * *